US009713829B2

(12) United States Patent
Holtby et al.

(10) Patent No.: US 9,713,829 B2
(45) Date of Patent: Jul. 25, 2017

(54) WASHING APPARATUS

(71) Applicant: Katch Kan Holdings Ltd., Edmonton (CA)

(72) Inventors: Quinn A. J. Holtby, Edmonton (CA); Dallas Greenwood, Edmonton (CA)

(73) Assignee: Katch Kan Holdings Ltd., Edmonton (CA)

( * ) Notice: Subject to any disclaimer, the term of this patent is extended or adjusted under 35 U.S.C. 154(b) by 0 days.

(21) Appl. No.: 14/923,208

(22) Filed: Oct. 26, 2015

(65) Prior Publication Data

US 2017/0095844 A1 Apr. 6, 2017

(30) Foreign Application Priority Data

Oct. 5, 2015 (CA) ..... 2907256

(51) Int. Cl.

| | |
|---|---|
| ***B08B 3/00*** | (2006.01) |
| ***B08B 7/04*** | (2006.01) |
| ***F17C 13/02*** | (2006.01) |
| ***B08B 3/02*** | (2006.01) |
| ***B08B 3/10*** | (2006.01) |

(52) U.S. Cl.

CPC ..... *B08B 7/04* (2013.01); *B08B 3/02* (2013.01); *B08B 3/10* (2013.01); *F17C 13/021* (2013.01); *F17C 2227/04* (2013.01); *F17C 2250/03* (2013.01); *F17C 2250/07* (2013.01)

(58) Field of Classification Search

CPC ..... B08B 7/04; B08B 3/02; B08B 3/10; F17C 13/021; F17C 2250/03; F17C 2205/07; F17C 2227/04

See application file for complete search history.

(56) References Cited

U.S. PATENT DOCUMENTS 4,059,123 A * 11/1977 Bartos ..... B08B 3/00 134/102.2
5,224,236 A * 7/1993 Sallquist ..... E01H 1/001 126/271.1
5,287,589 A * 2/1994 Hughes ..... B08B 15/00 15/321
5,469,597 A * 11/1995 Page ..... A47L 11/34 15/321

(Continued)

OTHER PUBLICATIONS

"EnviroVac: Accelerating the Transfer and Clean-Up of Liquids and Slurries With Superior Performance and Unitized Packaging," National Oilwell Varco, Houston, Texas, ©2014, 2-page pamphlet.

(Continued)

*Primary Examiner* — Dung Van Nguyen
(74) *Attorney, Agent, or Firm* — Christensen O'Connor Johnson Kindness PLLC

(57) ABSTRACT

A washing apparatus has a vacuum unit and a pressure washer unit. The vacuum unit has a mud tank, a first centrifuge, and a second centrifuge, and the pressure washer unit has a first water tank having a bottom, a top and a side, and a second water tank having a bottom, a top and a side. A frame having a top, a base and four corners supports the vacuum unit and pressure washer unit. The first centrifuge and the second centrifuge are fixed in respective first and second corners of the frame, and the first water tank and second water tank are fixed in respective third and fourth corners of the frame.

26 Claims, 8 Drawing Sheets

(56) References Cited

U.S. PATENT DOCUMENTS

| | | | | |
|---|---|---|---|---|
| 5,500,976 | A * | 3/1996 | Rohrbacher | A47L 11/38 15/320 |
| 7,954,201 | B1 * | 6/2011 | Martinez | B08B 3/02 15/320 |
| 8,524,010 | B2 * | 9/2013 | Nordlund | B08B 3/026 134/113 |
| 8,677,555 | B1 * | 3/2014 | McCallum | E01H 1/103 15/320 |
| 9,376,932 | B2 * | 6/2016 | Sales, Jr. | |
| 2003/0041407 | A1 * | 3/2003 | Savage | A47L 11/34 15/321 |
| 2004/0118439 | A1 * | 6/2004 | Durrant | A47L 11/34 134/94.1 |
| 2006/0027253 | A1 * | 2/2006 | Kaiser | B08B 3/026 134/94.1 |
| 2009/0050183 | A1 * | 2/2009 | Rice | B08B 3/14 134/107 |
| 2011/0036418 | A1 * | 2/2011 | Hendy | B08B 3/02 137/335 |
| 2011/0253179 | A1 * | 10/2011 | Barrios | B08B 3/026 134/115 R |

OTHER PUBLICATIONS

"SpaceSaver VTS: Progressing the Transfer of Drilled Materials With High Capacity and Quiet Operation," National Oilwell Varco, Houston, Texas, ©2014, 1-page pamphlet.

"Tank Cleaning Unit: Providing Efficient Cleaning of Tank Vessels With Proven Design and Versatility," National Oilwell Varco, Houston, Texas, ©2012, 1-page pamphlet.

Pressure Washer Unit, Katch Kan, Edmonton, Canada, date drawn Jul. 2014, 1-page engineering drawing.

* cited by examiner

WASHING APPARATUS

TECHNICAL FIELD

Washing apparatus

BACKGROUND

Industrial cleaning, such as the cleaning of oil rigs, often requires the use of industrial vacuums and pressure washers. Vacuum trucks are used to bring pressure washers and vacuums to industrial operations. However, these trucks require a large space to operate it in. Small scale vacuums and pressure washers are preferable to clean interior or difficult-to-access areas in factories, plants, oil rigs, and other industrial operations.

SUMMARY

In an embodiment, there is provided a washing apparatus, comprising a vacuum unit, the vacuum unit comprising a tank, a first centrifuge, and a second centrifuge; a pressure washer unit, the pressure washer unit comprising a first water tank having a bottom, a top and a side, and a second water tank having a bottom, a top and a side; a frame having a top, a base and four corners; the frame supporting the portable vacuum unit and pressure washer unit, the first centrifuge and the second centrifuge being fixed in respective first and second corners of the frame, and the first water tank and second water tank being fixed in respective third and fourth corners of the frame.

In an embodiment, there is provided a washing apparatus, comprising a vacuum unit, the vacuum unit comprising a tank, the tank comprising an upper portion, a lower portion, an inlet, an outlet, and a tube; the outlet being formed in the lower portion of the tank and the inlet being formed above the outlet at waist height on the tank; the tube extending interior to the tank from the inlet to the upper portion of the tank; a pressure washer unit; and a frame, the frame supporting the portable vacuum unit and pressure washer unit.

In an embodiment, there is provided a washing apparatus, comprising a vacuum unit, the vacuum unit comprising a tank and a pump; a sensor suspended inside the tank for detecting the level of fluid in the tank; a pressure washer unit; a frame, the frame supporting the portable vacuum unit and pressure washer unit; the tank comprising an inlet and an outlet, a first actuator and a second actuator; the first actuator initiating the pump to pump material into the inlet and the second actuator not operating when the sensor does not detect fluid at a pre-determined height in the mud tank; and the second actuator initiating the pump to pump material out of the mud tank through the outlet and the first actuator not operating when the sensor detects fluid at a pre-determined height in the mud tank.

In an embodiment, there is provided a washing apparatus, comprising a frame; a vacuum unit mounted within the frame, the vacuum unit comprising a vacuum tank, a first centrifuge, and a second centrifuge; a pressure washer unit mounted within the frame, the pressure washer unit comprising a first water tank and a second water tank; the vacuum tank being situated within the frame with variable distance between the vacuum tank and nearest portions of the frame, the variable distance creating pockets within the frame, the first centrifuge, the second centrifuge, the first water tank and the second water tank being located within the pockets.

In an embodiment, there is provided a washing apparatus, comprising: a frame defining a volume having a boundary; a vacuum unit mounted on the frame, the vacuum unit comprising a mud tank, the mud tank having a top and a bottom; an outlet from the bottom of the mud tank extending from within the mud tank to the boundary; an inlet into the mud tank above the outlet, the inlet extending from within the mud tank to the boundary; a tube extending from the inlet upward into the mud tank; and a pressure washer unit mounted on the frame within the boundary.

In various embodiments, there may be included any one or more of the following features: the first water tank has a first viewing window and a second viewing window on the side of the first water tank, the first viewing window being nearer to the bottom of the first water tank than the second viewing window; the frame has a pair of holes extending through the base of the frame for receiving forks of a lifting device; the frame has lifting lugs on the top of the frame to permit lifting of the frame by a crane or helicopter; the frame has a front and a back, the front of the frame has a first sling hook and a second sling hookup, and the back of the frame has a third sling hookup and a fourth sling hookup for attaching the frame to a skid mount; the base of the frame is a skid plate for containing leaks from the vacuum unit and pressure washer unit; and the vacuum tank is a vertically oriented cylindrical tank and the frame is rectangular with corners and the pockets are corners of the frame.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims. In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

Figure 4:
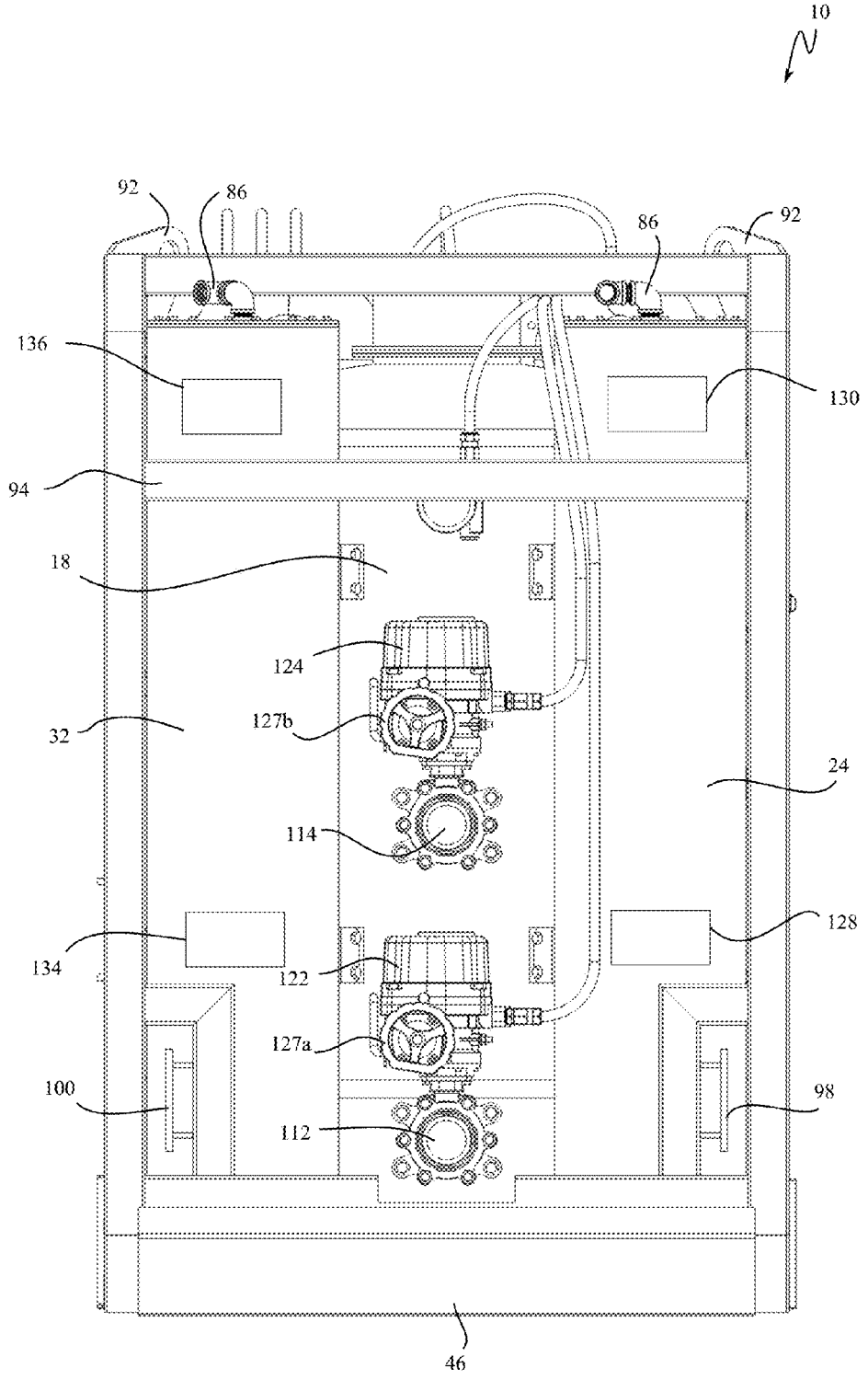
FIG. 4 is a front view of an embodiment of a washing apparatus.
Figure 5:
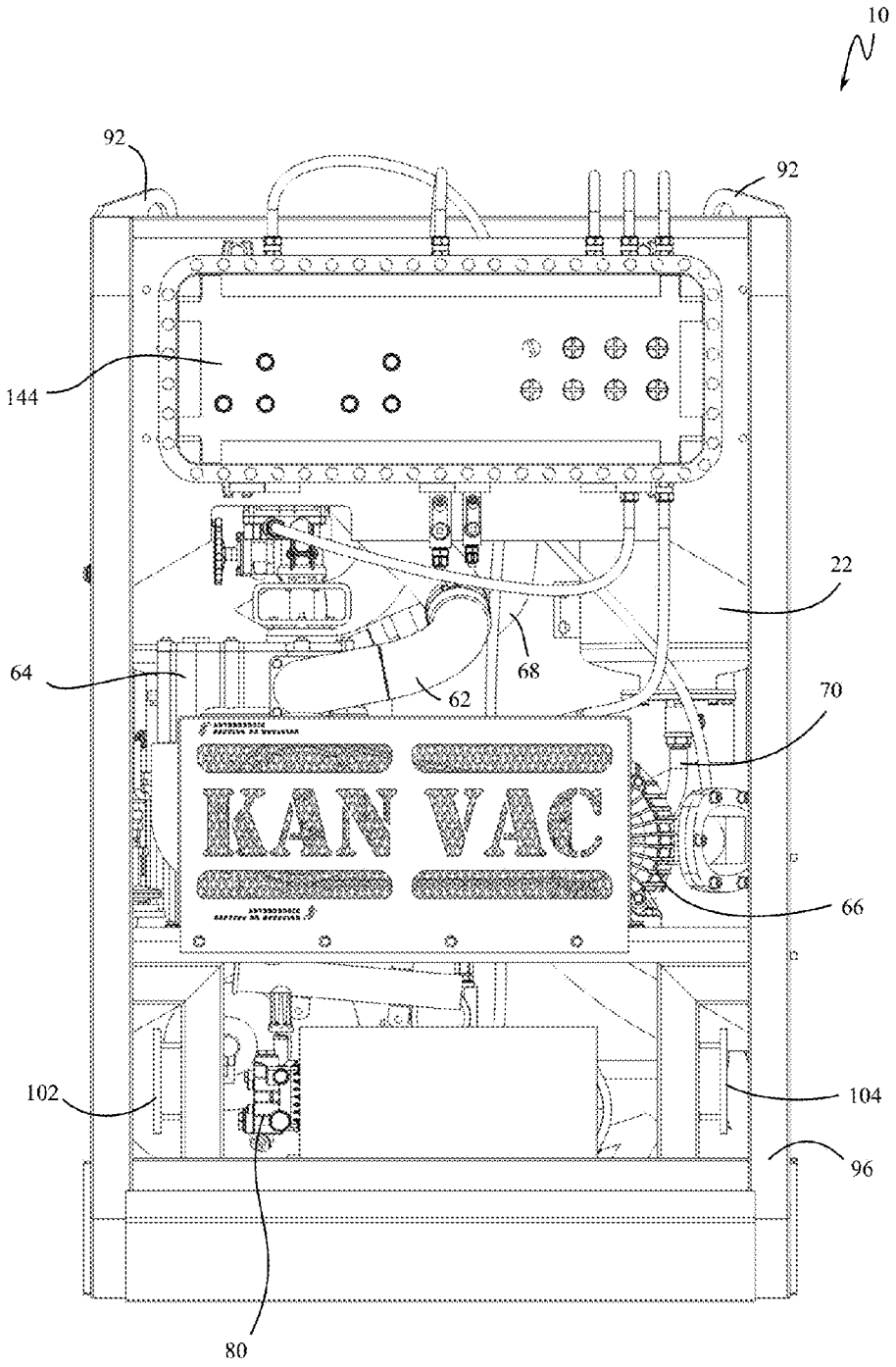
FIG. 5 is a back view of an embodiment of a washing apparatus.
Figure 6:
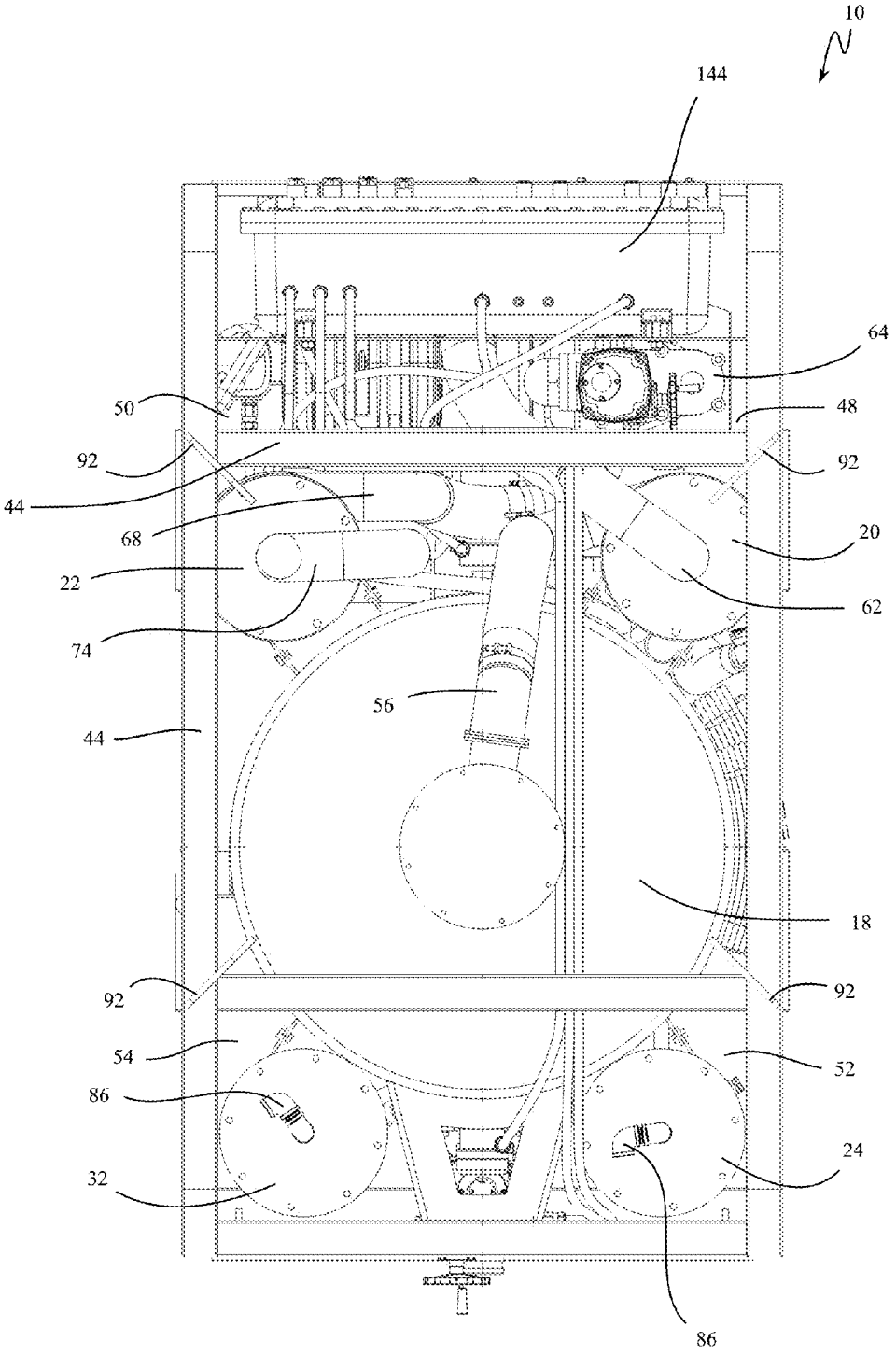
FIG. 6 is a top view of an embodiment of a washing apparatus.
Figure 7:
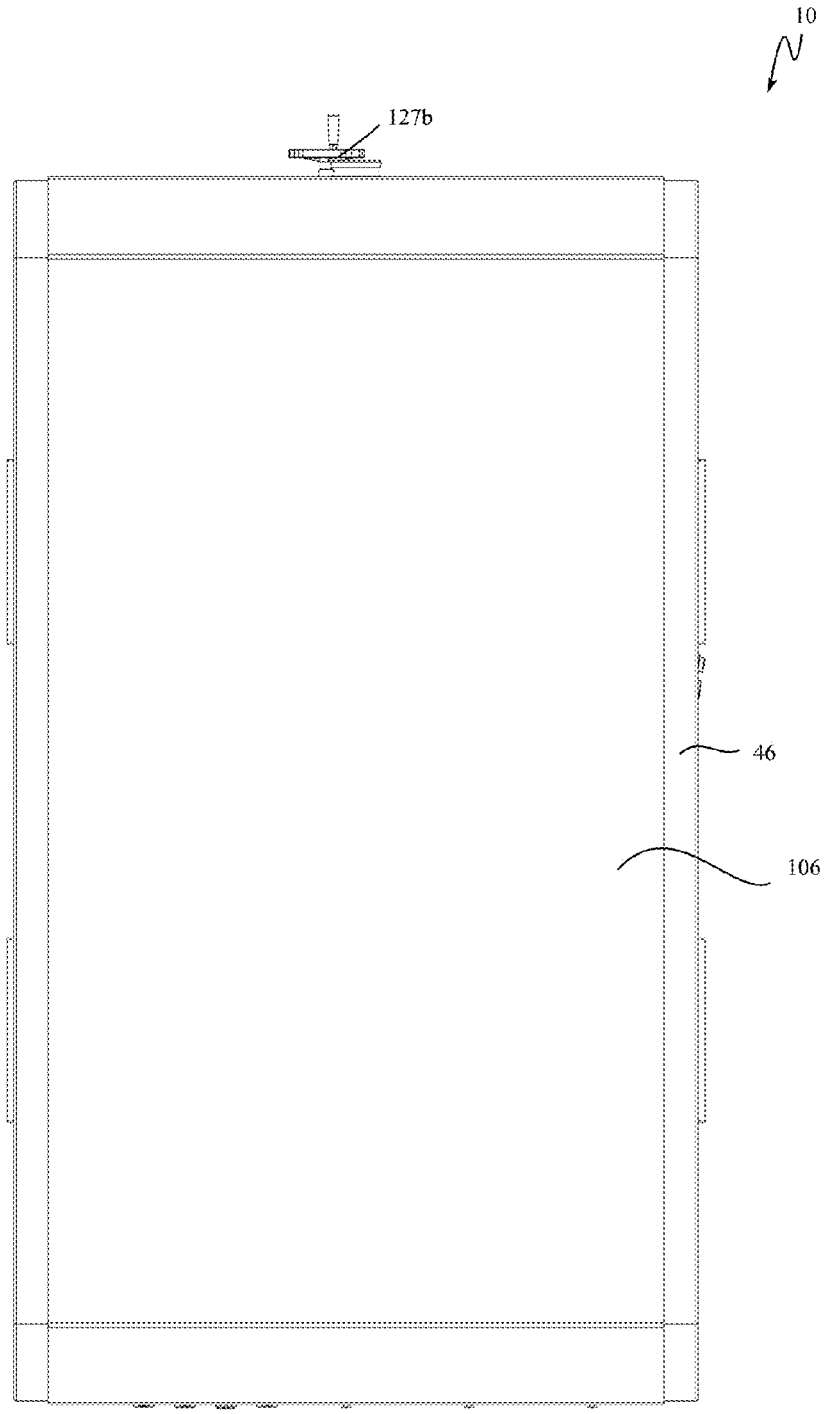
FIG. 7 is a bottom view embodiment of a washing apparatus.

As shown in FIGS. 1-7, in an embodiment, a washing apparatus 10 comprises a vacuum unit 12, a pressure washer unit 14, and a frame 16. The vacuum unit 12 comprises a mud tank 18, also called a vacuum tank, a first centrifuge 20, and a second centrifuge 22. The pressure washer unit 14 comprises a first water tank 24 having a bottom 26, a top 28 and a side 30, and a second water tank 32 having a bottom 34, a top 36 and a side 38. The frame 16 may support the vacuum unit 12 and the pressure washer unit 14. In an embodiment, the frame 16 defines a volume having a boundary 40, and the vacuum unit 12 and the pressure washer unit 14 may be mounted in the frame 16. The vacuum tank 12 may be situated within the frame 16 with variable distance between the vacuum tank 12 and nearest portions of the frame 16, the variable distance creating pockets 42 within the frame 16, the first centrifuge 20, the second centrifuge 22, the first water tank 24 and the second water tank 32 being located within the pockets 42. The frame 16 may be rectangular with corners. The frame 16 may include a top 44, a base 46 and four corners 48, 50, 52 and 54, as shown in FIGS. 6 and 7.

Figure 2:
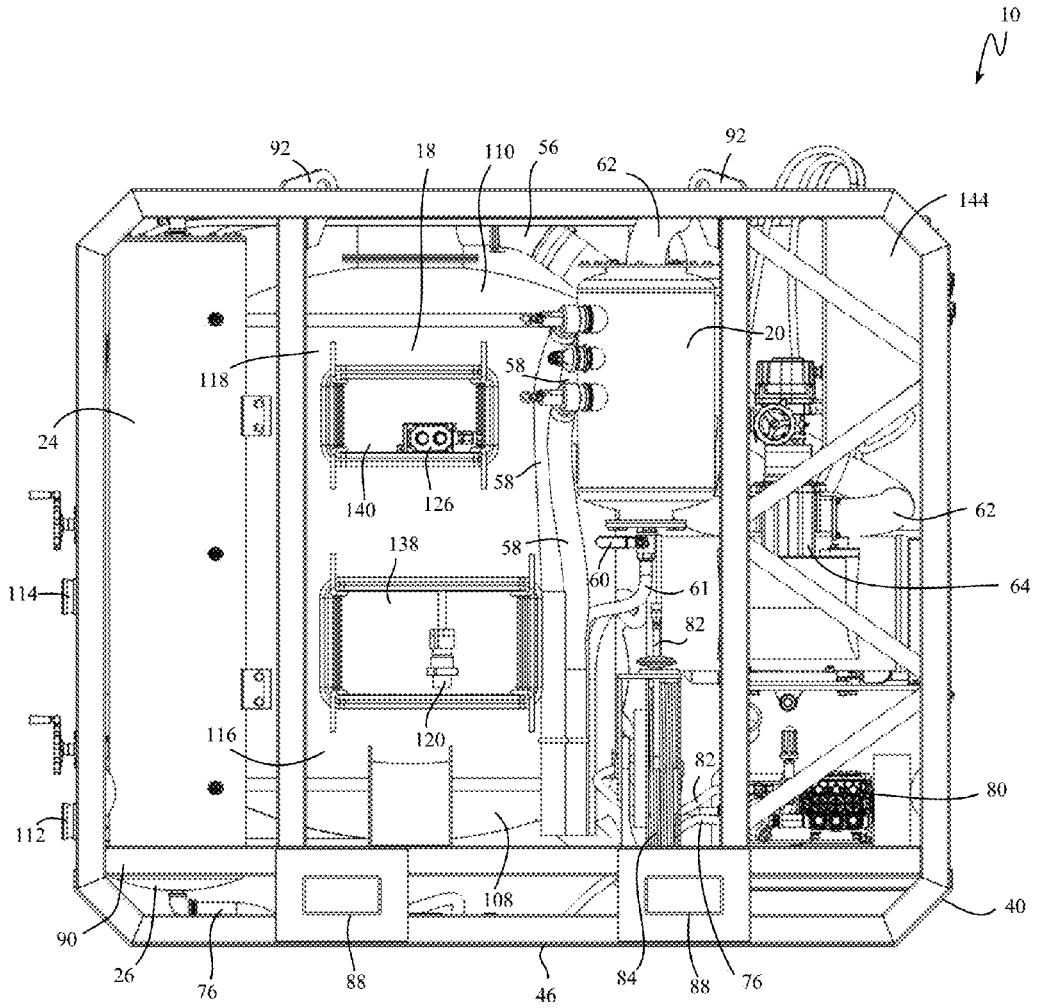
FIG. 2 is a side view of an embodiment of a washing apparatus.

As shown in FIG. 6, the first centrifuge 20 and the second centrifuge 22 may be fixed in or adjacent to the respective first and second corners 48 and 50 of the frame 16, and the first water tank 24 and the second water tank 32 may be fixed in or adjacent to the respective third and fourth corners 52 and 54 of the frame 16. The first centrifuge 20 may be in fluid connection with the mud tank 18, for example through a first connector tube 56. When the vacuum unit 12 is in suction mode, fluid flows through the first connector tube 56 in the mud tank 18 to the first centrifuge 20. The first connector tube 56 may penetrate the side of the first centrifuge 20, allowing fluid to flow into the centrifuge 20. As shown in FIG. 2, the first centrifuge 20 then separates the immiscible solids or fluids, discharging heavy liquids and solids into waste tubes 58. A release valve 60 and a release tube 61 at the base of the first centrifuge 20 provides release of accumulated fluids and solids at the base of the first centrifuge 20. Lighter fluids flow out of the top of the first centrifuge 20 into a second connector tube 62.

Figure 3:
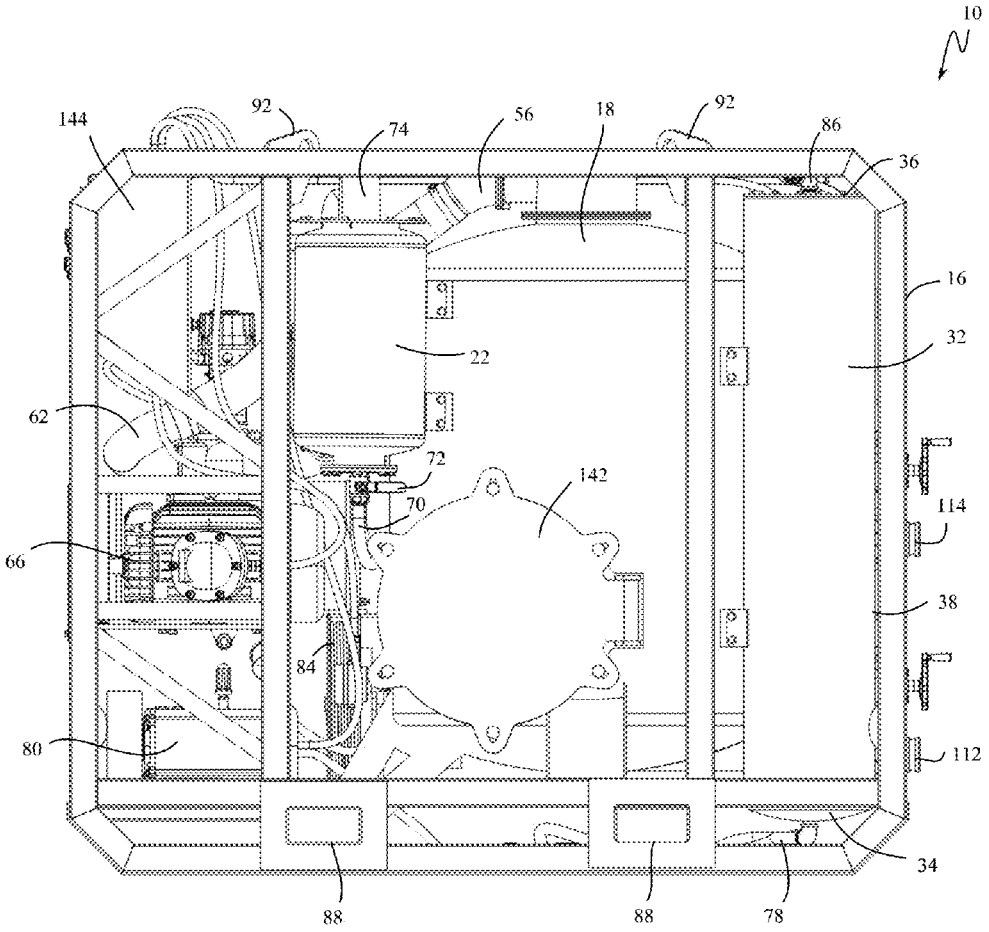
FIG. 3 is a further side view of an embodiment of a washing apparatus.

As shown in FIGS. 1-3, and 5, the vacuum unit 12 may further comprise a pump 64, driven by a motor 66. The first centrifuge 20 may be in fluid connection with the pump 64 through the second connector tube 62. As shown in FIG. 6, the pump 64 may be in fluid connection with the second centrifuge 22 through a third connector tube 68. FIG. 3 shows separated fluids and solids are discharged from the second centrifuge 22 through a waste tube 70 having a release valve 72. The remaining fluid flows out of the top of the second centrifuge 22 through an end tube 74.

Figure 8:
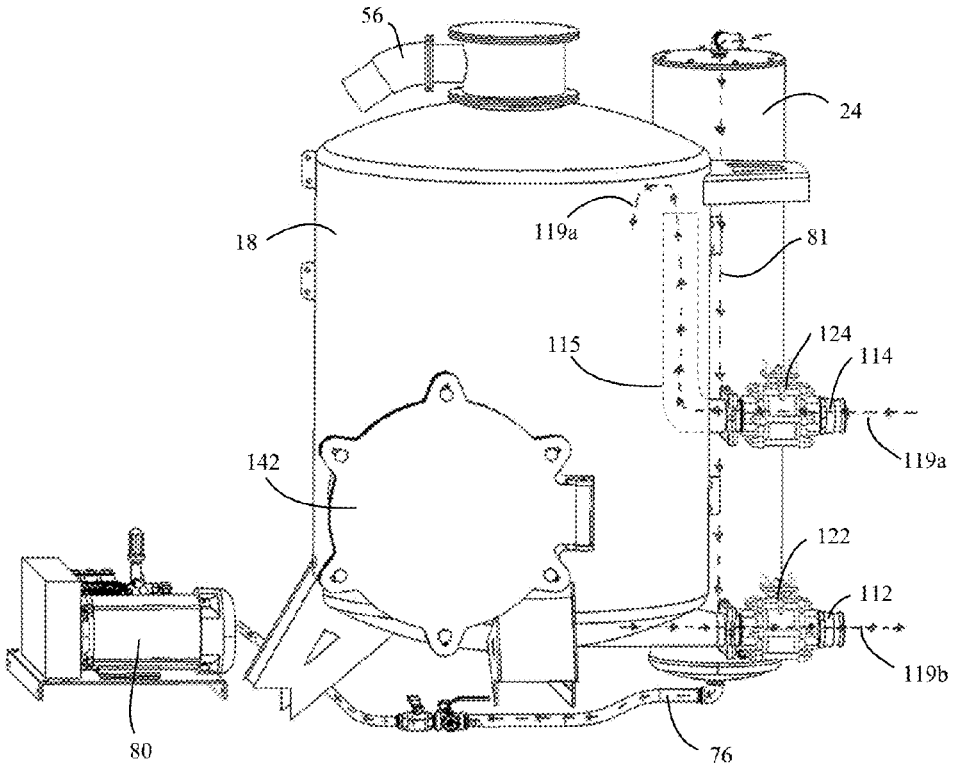
FIG. 8 is a perspective view of an embodiment of part of a washing apparatus.

As shown in FIGS. 2, 3 and 8, in the pressure washer unit 14, the first water tank 24 and the second water tank 32 are connected by, respectively, a first water tube 76 and a second water tube 78 to a motor pump unit 80. As shown by arrows 81 in FIG. 8, during operation of the pressure washer unit 14, water flows from either the first water tank 24 through the first water tube 76 or from second water tank 32 through second water tube 78 to the motor pump unit 80, which pressurizes the water and pumps the water out through a hose 82. The hose 82 may be coiled around a reel 84. At the top of each of the first water tank 24 and the second water tank 32 there may be water inlets 86.

As shown in FIGS. 1-7, the mud tank 18 may be a vertically oriented cylindrical tank. By being positioned in the pockets 42 or the corners 48, 50, 52 and 54, the weight of the first centrifuge 20, the second centrifuge 22, the first water tank 24 and the second water tank 32 is distributed within the frame 16 to provide stability to the washing apparatus 10.

As shown in FIGS. 1-6, the frame 16 has a pair of holes 88 extending through the base 46 of the frame 16 for receiving forks of a lifting device, such as a forklift. The frame 16 may include supporting arms 90 which partially or fully support the vacuum unit 12 and the pressure washer unit 14 above the base 46 of the frame 16. Lifting lugs 92 on the top 44 of the frame 16 permit lifting of the frame 16 by a crane or helicopter. FIGS. 4 and 5 show a front 94 and a back 96 of the frame 16. The front 94 of the frame 16 may have a first sling hookup 98 and a second sling hookup 100, and the back 96 of the frame 16 has a third sling hookup 102 and a fourth sling hookup 104. As shown in FIG. 7, the base 46 of the frame 16 may be a skid plate 106 for containing leaks from the vacuum unit 12 and the pressure washer unit 14.

As shown in FIGS. 2 and 8, the mud tank 18 has a bottom 108 and a top 110. An outlet 112 may come from the bottom 108 of the mud tank 18 and extend from within the mud tank 18 to the boundary 40 of the frame 16. There may be an inlet 114 into the mud tank 18, and the inlet 114 may extend from within the mud tank 18 to the boundary 40. A tank tube 115 may extend from the inlet 114 upward into the mud tank 18. The mud tank 18 further may have a lower portion 116, and an upper portion 118. The outlet 112 is formed in the lower portion 116 of the mud tank 18 and the inlet 114 may be formed above the outlet 112 at waist height on the mud tank 18. The tank tube 115 may extend interiorly to the mud tank 18 from the inlet 114 to the upper portion 118 of the mud tank 18. FIG. 8 shows an inflow 119*a* of fluid through the inlet 114 to the mud tank 18 and into the upper portion 118 of the mud tank 18 through the tank tube 115. FIG. 8 also shows an outflow 119*b* of fluid out of the mud tank 18 through the outlet 112.

Figure 1:
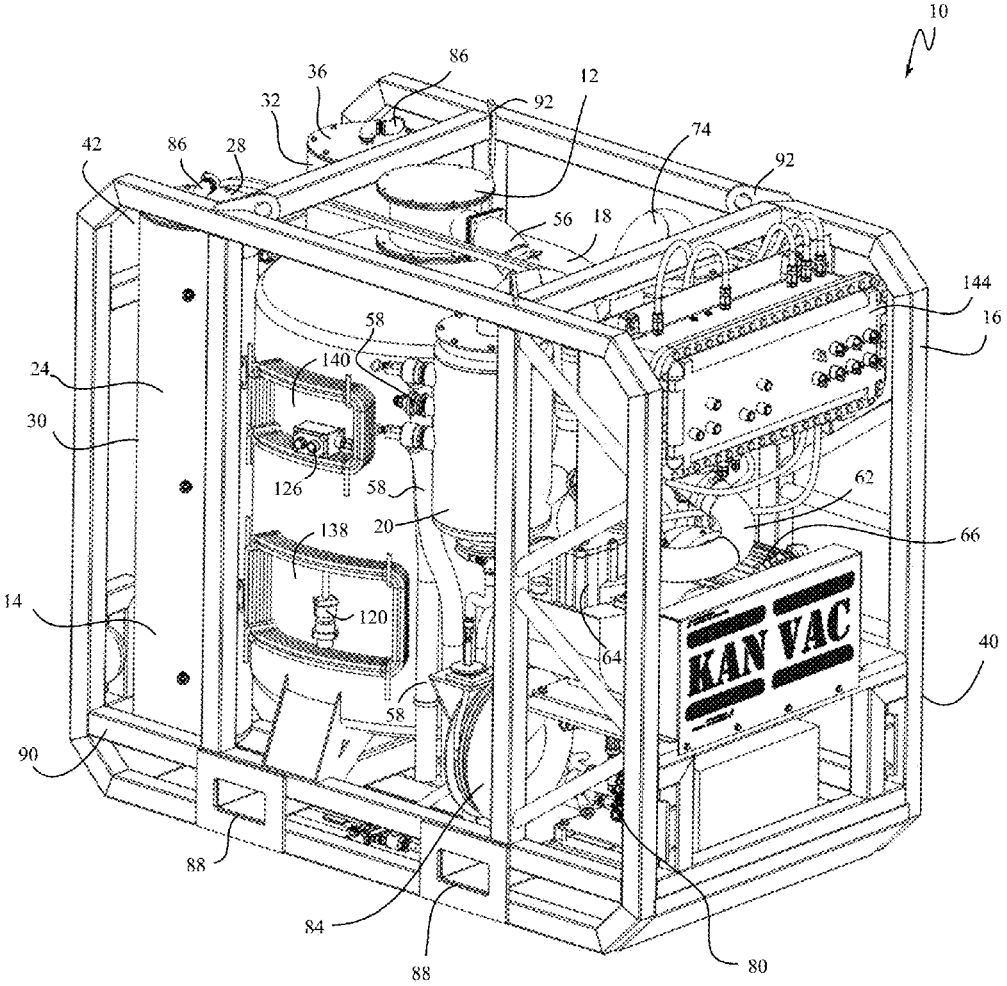
FIG. 1 is a perspective view of an embodiment of a washing apparatus.

As shown in FIGS. 1 and 2, a sensor 120 suspended inside the mud tank 18 may be used to detect the level of fluid in the mud tank 18, and to send signals to the power board 144 to reverse the operation of the pump 64 when the tank is full or empty. The vacuum unit 12 may operate as follows: a first actuator 122 initiates the pump 64 to pump material into the inlet 114 and a second actuator 124 does not operate when the sensor 120 does not detect fluid at a pre-determined height in the mud tank 18; and the second actuator 124 initiates the pump 64 to pump material out of the mud tank 18 through the outlet and the first actuator 122 does not operate when the sensor 120 detects fluid at a pre-determined height in the mud tank 18. When the first actuator 122 is operating, the pump 64 provides suction to bring material into the mud tank 18 and through the vacuum unit 12. When the second actuator 124 is operating, the pump 64 discharges material from the mud tank 18.

The outlet 112 and the inlet 114, together with the first and second actuators 122 and 124, are installed as low as possible on the mud tank 18 to provide for safe operation of the washing apparatus 10. A low height for the inlet and outlet allows an operator to easily lift and connect a hose to the outlet 112 or the inlet 114. By the tank tube 115 being in fluid connection from the inlet 114 to the upper portion 118 of the mud tank 18, the inlet 114 may be lowered without causing back flow of material if operation of the vacuum unit 12 is stopped when the fluid level in the mud tank 18 is above the inlet 114 but has not yet reached the height of the fluid sensor 120. The first and second actuators 122 and 124 may be turned on or off using a selector switch 126. When the first and second actuators 122 and 124 are turned on, the vacuum unit 12 runs automatically using the fluid sensor 120 and actuators 122 and 124, thus eliminating the need to have an operator remain at the washing apparatus 10 while the vacuum unit 12 is in use. When the first actuator 122 and the second actuator 124 are turned off using the selector switch 126, the vacuum unit 12 may be operated manually, using a first hand-wheel 127*a* and a second hand-wheel 127*b*, respectively.

As shown in FIG. 4, the side 30 of the first water tank 24 may have a lower viewing window 128 and an upper viewing window 130, the lower viewing window 128 being nearer to the bottom of the first water tank 24 than the upper viewing window 130. The second water tank 32 may also have a lower viewing window 134 and an upper viewing window 136, having the same configuration as the viewing windows in the first water tank 24. The mud tank 18 may also have a lower viewing window 138 and an upper viewing window 140 on the side of the mud tank 18, the lower viewing window 138 being nearer to the bottom of the mud tank 18 than the upper viewing window 140. Using some or all of the viewing windows 128, 130, 134, 136, 138 and 140 an operator may observe the level of fluid or material in the mud tank 18 or the water tanks 24 and 32 in order to determine whether to stop or alter the operation of the washing apparatus 10. An operator may assess the fluid level in the mud tank 18 using the viewing windows 138 and 140 to determine when to manually reverse the operations of the vacuum unit 12.

As shown in FIG. 3, the mud tank 18 has an access door 142 to allow periodic cleaning of the interior of the mud tank 18.

As shown in FIGS. 1-3, 5 and 6, the power board 144 supplies power to and electronically connects sensors, actuators, motors and pumps.

What is claimed is:

1. A washing apparatus, comprising:

a vacuum unit, the vacuum unit comprising a mud tank, a first centrifuge, and a second centrifuge;

a pressure washer unit, the pressure washer unit comprising a first water tank having a bottom, a top and a side, and a second water tank having a bottom, a top and a side;

a frame having a top, a base and first, second, third and fourth corners;

the frame supporting the vacuum unit and pressure washer unit, the first centrifuge and the second centrifuge being fixed respectively to the first and second corners of the frame, and the first water tank and second water tank being fixed respectively to the third and fourth corners of the frame.

2. The washing apparatus of claim 1 in which the mud tank further comprises an upper portion, a lower portion, an inlet, an outlet and a tank tube, and the outlet is formed in the lower portion of the mud tank and the inlet is formed above the outlet.

3. The washing apparatus of claim 2 in which the inlet is formed at waist height on the mud tank.

4. The washing apparatus of claim 2 further comprising a sensor suspended inside the mud tank for detecting the level of fluid in the mud tank.

5. The washing apparatus of claim 4 in which the vacuum unit further comprises a pump.

6. The washing apparatus of claim 5 in which the mud tank further comprises a first actuator and a second actuator, the first actuator initiating the pump to pump material into the inlet and the second actuator not operating when the sensor does not detect fluid at a pre-determined height in the mud tank, and the second actuator initiating the pump to pump material out of the mud tank through the outlet and the first actuator not operating when the sensor detects fluid at a pre-determined height in the mud tank.

7. The washing apparatus of claim 1 in which the first water tank has a first viewing window and a second viewing window on the side of the first water tank, the first viewing window being nearer to the bottom of the first water tank than the second viewing window.

8. The washing apparatus of claim 1 in which the frame has a pair of holes extending through the base of the frame for receiving forks of a lifting device.

9. The washing apparatus of claim 1 in which the frame has lifting lugs on the top of the frame to permit lifting of the frame by a crane or helicopter.

10. The washing apparatus of claim 1 in which the frame has a front and a back, the front of the frame has a first sling hookup and a second sling hookup, and the back of the frame has a third sling hookup and a fourth sling hookup for attaching the frame to a skid mount.

11. The washing apparatus of claim 1 in which the base of the frame is a skid plate for containing leaks from the vacuum unit and pressure washer unit.

12. The washing apparatus of claim 1 in which the mud tank is a vertically oriented mud tank.

13. A washing apparatus, comprising:

a frame having a top and a base;

a vacuum unit mounted within the frame, the vacuum unit comprising a vacuum tank, a first centrifuge, and a second centrifuge;

a pressure washer unit mounted within the frame, the pressure washer unit comprising a first water tank and a second water tank;

the vacuum tank being situated within the frame with variable distance between the vacuum tank and nearest portions of the frame, the variable distance creating pockets within the frame, the first centrifuge, the second centrifuge, the first water tank and the second water tank being located within the pockets.

14. The washing apparatus of claim 13 in which the vacuum tank is a vertically oriented cylindrical tank, the frame is rectangular with corners and the pockets are corners of the frame.

15. The washing apparatus of claim 13 in which the vacuum tank has a top and bottom.

16. The washing apparatus of claim 15 in which the frame defines a volume having a boundary.

17. The washing apparatus of claim 16 further comprising an outlet from the bottom of the vacuum tank extending from within the vacuum tank to the boundary, an inlet into the vacuum tank above the outlet, the inlet extending from within the vacuum tank to the boundary, and a tank tube extending from the inlet upward into the vacuum tank.

18. The washing apparatus of claim 17 further comprising a sensor suspended inside the vacuum tank for detecting the level of fluid in the vacuum tank.

19. The washing apparatus of claim 18 in which the vacuum unit further comprises a pump.

20. The washing apparatus of claim 19 in which the vacuum tank further comprises a first actuator and a second actuator, the first actuator initiating the pump to pump material into the inlet and the second actuator not operating when the sensor does not detect fluid at a pre-determined height in the vacuum tank, and the second actuator initiating the pump to pump material out of the vacuum tank through the outlet and the first actuator not operating when the sensor detects fluid at a pre-determined height in the vacuum tank.

21. The washing apparatus of claim 13 in which the first water tank has a first viewing window and a second viewing window on a side of the first water tank, the first viewing window being nearer to a bottom of the first water tank than the second viewing window.

22. The washing apparatus of claim 13 in which the frame has a pair of holes extending through the base of the frame for receiving forks of a lifting device.

23. The washing apparatus of claim 13 in which the frame has lifting lugs on the top of the frame to permit lifting of the frame by a crane or helicopter.

24. The washing apparatus of claim 13 in which the frame has a front and a back, the front of the frame has a first sling hookup and a second sling hookup, and the back of the frame has a third sling hookup and a fourth sling hookup for attaching the frame to a skid mount.

25. The washing apparatus of claim 13 in which the base of the frame is a skid plate for containing leaks from the vacuum unit and pressure washer unit.

26. A washing apparatus, comprising:

a frame defining a volume having a boundary;

a vacuum unit mounted on the frame, the vacuum unit comprising a mud tank, the mud tank having a top and a bottom;

an outlet from the bottom of the mud tank extending from within the mud tank to the boundary;

an inlet into the mud tank above the outlet, the inlet extending from within the mud tank to the boundary;

a tank tube extending from the inlet upward into the mud tank; and a pressure washer unit mounted on the frame within the boundary.

* * * * *